US006237561B1

(12) United States Patent
Takahashi

(10) Patent No.: US 6,237,561 B1
(45) Date of Patent: May 29, 2001

(54) DIRECT INJECTION ENGINE FUEL INJECTION CONTROL APPARATUS AND METHOD

(75) Inventor: Tomohiko Takahashi, Isehara (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/413,530

(22) Filed: Oct. 6, 1999

(30) Foreign Application Priority Data

Oct. 19, 1998 (JP) ..... 10-296878

(51) Int. Cl.[7] ..... F02B 17/00
(52) U.S. Cl. ..... 123/295
(58) Field of Search ..... 123/295, 325

(56) References Cited

U.S. PATENT DOCUMENTS 4,957,194 * 9/1990 Sawa et al. ..... 192/0.096
5,490,815 * 2/1996 Kato et al. ..... 477/181
5,983,857 * 11/1999 Mamiya et al. ..... 123/325
6,003,489 * 12/1999 Kamura et al. ..... 123/305
6,085,717 * 7/2000 Kamura et al. ..... 123/295
6,102,831 * 8/2000 Wakahara et al. ..... 477/169

FOREIGN PATENT DOCUMENTS 9-158767 6/1997 (JP) .

* cited by examiner

*Primary Examiner*—Andrew M. Dolinar
*Assistant Examiner*—Arnold Castro
(74) *Attorney, Agent, or Firm*—Foley & Lardner

(57) ABSTRACT

In an apparatus and method of controlling the fuel injection of a direct injection engine, switching is performed, in accordance with the driving condition, between homogeneous combustion, in which fuel is injected from the fuel injection valve during the intake stroke and combusted, and stratified combustion, in which fuel is injected from the fuel injection valve during the compression stroke and combusted, and the injection of fuel from the fuel injection valve is stopped under a predetermined deceleration condition. In the case that the condition in which the injection of the fuel from the fuel injection valve is stopped and the fuel injection is to be resumed by the stratified combustion, the resumption of the injection of fuel from the fuel injection valve is delayed by a predetermined amount of time.

9 Claims, 6 Drawing Sheets

DIRECT INJECTION ENGINE FUEL INJECTION CONTROL APPARATUS AND METHOD

BACKGROUND OF THE INVENTION

The invention relates to fuel injection control apparatus and method for a directly injected fuel engine, and more particularly to control of fuel injection of an engine capable of switching between stratified combustion and homogeneous combustion and which provides a reduction in fuel when decelerating or the like, whereby the start of fuel injection from the condition in which the fuel is reduced is controlled.

In recent years, direct injection engines have been developed for use as automotive engines, a fuel injection valve that injects fuel such as gasoline directly into the combustion chamber being provided, wherein in the low-load and medium-load regions, by injecting fuel during the compression stroke, stratified combustion is achieved by generating a stratified combustible mixture only in the region of the spark plug, thereby enabling a great increase in the leanness of the air-fuel ratio, and providing a great improvement in fuel consumption and emissions performance. In this system, however, when the load exceeds a predetermined load, to achieve the desired torque with a limited cylinder volume, fuel is injected on the intake stroke, thereby forming a homogeneous air-fuel mixture for the performance of homogeneous combustion.

As a measure to improve fuel economy, in the decelerating condition, in which the throttle valve is fully closed with the engine speed at or above a predetermined speed, the injection of fuel into the engine has been cut in the past, in what has come to be known as the deceleration fuel-cutoff mode.

SUMMARY OF THE INVENTION

According to an investigation by the inventor, in an engine of the past, when in the deceleration fuel-cutoff condition, if the throttle valve is opened in order to accelerate, thereby starting the injection of fuel again, there can be envisioned differences in response, such as torque up-ramping, depending upon whether the injection is resumed so as to perform stratified combustion or resumed so as to start homogeneous combustion.

More specifically; in the case in which the throttle opening D is in the fully closed condition, so that the fuel is cutoff, if the driver operates the accelerator, so that the throttle opening D goes into the opened condition and fuel injection is started, the torque T and vehicle forward and reverse acceleration "a" characteristics in response to engine fuel combustion are as shown in FIG. 4A and FIG. 4B.

That is, when the fuel cutoff is ended and fuel injection is started again, the typical torque T up-ramping response and vehicle acceleration "a" response are as particularly shown by the broken lines $a_P$ and $T_P$ of FIG. 4A, with respect to stratified combustion, and are as shown in FIG. 4B, with respect to homogeneous combustion, the response tending to differ, depending upon the mode of combustion.

Additionally, consider the case shown in FIG. 5A and FIG. 5B, in which the fourth cylinder (#4cyl) is observed, with the fuel cutoff stopped and fuel injection started at the time $T_R$. The top parts of FIG. 5A and FIG. 5B show the reference signal (REF SIG), and the horizontal axis in both of these drawings represents the crank angle $\theta_C$.

In the case of homogeneous combustion as shown in FIG. 5A, whereas it is not possible to inject fuel into the fourth cylinder and perform combustion therein, in the case of stratified combustion as shown in FIG. 5B, it is possible to inject fuel into the fourth cylinder and perform combustion therein. This is because, with homogeneous combustion, because it is necessary to inject fuel on the intake stroke, which is relatively far from the timing of ignition, even though the fourth cylinder is about to go into the compression stroke, it is not possible to perform fuel injection. In contrast to this, with stratified combustion, however, it is preferable to inject fuel on the compression stroke, and this is what enables actual fuel injection into the fourth cylinder. The result of this is that, in the case of stratified combustion it is possible to start combustion one cylinder earlier than the case of homogeneous combustion.

That is, referring again to the broken line in FIG. 4A and to FIG. 4B, when ending the cutoff of fuel injection and starting fuel injection, with respect to the response of torque T up-ramping and the acceleration "a" of the vehicle, indicated by the delay time $D_P$ from fuel cutoff with stratified combustion and the response, indicated by the delay time $D'_P$ from fuel cutoff with homogeneous combustion, the delay time $D_P$ tends to be smaller than the delay time $D'_P$.

Therefore, because of the above-noted difference in combustion characteristics between stratified combustion and homogeneous combustion, when fuel injection is started after fuel has been in the cutoff condition, it is thought that there is a tendency for a mutual difference in the torque T up-ramping characteristics and in the vehicle acceleration "a" characteristics.

The difference in response that occurs and is dependent upon the combustion mode when fuel injection is resumed causes such noticeable effects as acceleration shock to a rider of the vehicle, and can represent a deterioration in the feeling of quality of the vehicle as a product.

The present invention was developed as a result of the above-noted investigation, and has as an object the provision of a fuel injection control apparatus and method for a direct injection engine, whereby, when fuel injection is to be resumed from the condition in which the fuel is in the cutoff condition, such as during deceleration, it is possible to achieve equivalent drivability, regardless of whether the combustion is made in the stratified combustion or homogeneous combustion mode, thereby enabling the avoidance of such effects as acceleration shock.

In order to achieve the above-noted object, a direct injection engine fuel injection control apparatus comprises: a fuel injection valve injecting fuel directly into a combustion chamber; a combustion switching section, which, in accordance with driving conditions, switches between homogeneous combustion, in which the fuel is injected from the fuel injection valve during an intake stroke and combusted, and stratified combustion, in which the fuel is injected from the fuel injection valve during a compression stroke and combusted; a fuel cutoff section, which, in a predetermined deceleration driving condition, stops injection of the fuel from the fuel injection valve; and a resumption delay section, which, in the case that a fuel-cutoff recovery condition in which the injection of the fuel from the fuel injection valve is resumed after a fuel cutoff is satisfied, and also that resumption of the injection of the fuel from the fuel injection valve is to be done by the stratified combustion, delays the resumption of the injection of the fuel from the fuel injection valve by a predetermined amount of time.

In other words, a direct injection engine fuel injection control apparatus of the invention comprises fuel injection means for injecting fuel directly into a combustion chamber; combustion switching means for switching between homogeneous combustion, in which the fuel is injected from the fuel injection means during an intake stroke and combusted, and stratified combustion, in which the fuel is injected from the fuel injection means during a compression stroke and combusted; a fuel cutoff means for stopping injection of the fuel from the fuel injection means; and a resumption delay means, in the case that resumption of the injection of the fuel from the fuel injection means is to be done by the stratified combustion, for delaying the resumption of the injection of the fuel from the fuel injection means by a predetermined amount of time.

Besides, a method of controlling fuel injection in a direct injection engine of the present invention, comprises the steps of: switching, in accordance with driving conditions, between homogeneous combustion, in which fuel is injected from a fuel injection valve during an intake stroke and combusted, and stratified combustion, in which the fuel is injected from the fuel injection valve during a compression stroke and combusted; stopping injection of the fuel from the fuel injection valve at a predetermined deceleration condition; judging whether or not condition in which the injection of the fuel from the fuel injection valve is resumed is satisfied; judging whether or not resumption of the injection of the fuel from the fuel injection valve is to be made by stratified combustion; and delaying, in the case that judgment is made that the condition in which the injection of the fuel from the fuel injection valve is resumed is satisfied and also that the resumption of the injection of the fuel from the fuel injection valve is to be made by the stratified combustion, the resumption of the injection of the fuel from the fuel injection valve by a predetermined amount of time.

DETAILED DESCRIPTION OF THE PREFERRED EMBODIMENT

Preferred embodiment of the invention are described in detail below, with reference to relevant accompanying drawings.

Figure 1:
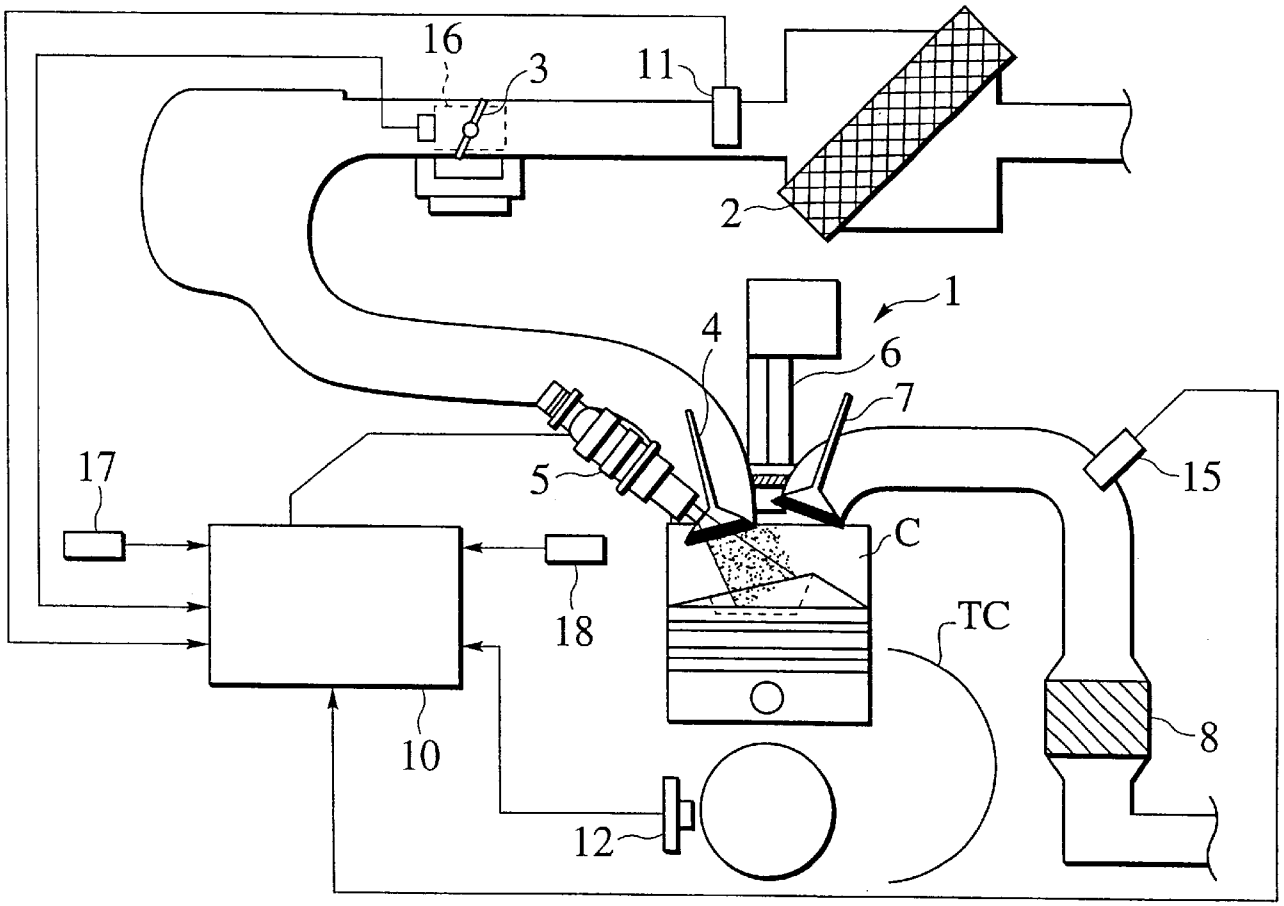
FIG. 1 is a drawing that shows the configuration of a direct injection engine fuel injection control apparatus according to an embodiment of the present invention.

An engine 1 that is shown in FIG. 1 is linked to a continuously variable transmission via a torque converter TC with a lockup mechanism.

In the engine 1, air that passes through an air cleaner 2 is measured by a throttle valve 3 that opens and closes under control of a motor (not shown in the drawing) in response to operation of an accelerator pedal. And this air is sucked into a cylinder via an intake valve 4.

The throttle valve 3 is configured so as to be opened and closed by means of an actuator such as a motor, and the actuator can be controlled in accordance with, for example, the results of detecting the accelerator opening, so as to drive the throttle valve 3 so that it reaches the target opening value.

An electromagnetic fuel injection valve 5 (fuel injection means) is provided on each cylinder, and injects fuel (gasoline) directly into each combustion chamber C, the fuel that is injected by the fuel injection valve 5 forming a gas mixture within the cylinder.

The gas mixture is ignited by a spark from a spark plug 6, and the exhaust from the combustion of the gas mixture is exhausted from within the cylinder via an exhaust valve 7, whereupon it is cleaned by a catalyst 8 and released into the atmosphere.

A control unit 10, which includes a microcomputer, a ROM, a RAM, and input/output ports, and the like, controls the fuel injection from the fuel injection valve 5 and also the ignition by means of the spark plug 6, and receives input signals from a variety of sensors.

The sensors provided are an air flow meter 11 that detects the amount of intake air into the engine 1, an oxygen sensor 15 that detects the air-fuel ratio of the exhaust in response to the concentration of oxygen in the exhaust gas, an idle switch 16 that is turned on when the throttle valve 3 is in the fully closed position, and a water temperature sensor 17 that detects the temperature of the cooling water.

In addition to providing a crank angle sensor 12, which outputs a position signal POS each unit crank angle, a cam sensor 18 is provided, which outputs a reference signal REF that includes cylinder identification information, each angle (for example, a crank angle of 180° CA for a four-cylinder engine) that corresponds to stroke phase difference of each cylinder, this being derived from a signal plate that is pivotally supported by the cam shaft.

The engine speed Ne of the engine 1 is detected by measuring the number of times a position signal POS is generated within a predetermined amount of time and the period of the generation of the reference signal REF.

The control unit 10, based on such information as the engine load, the engine speed, the cooling water temperature, and the amount of time after startup, sets the target air-fuel ratio, selects either homogeneous combustion, which injects fuel during the intake stroke, or stratified combustion, which injects fuel during the compression stroke, and controls the amount of fuel injection from the fuel injection valve 5 and the timing of fuel injection (fuel combustion switching means).

The control unit 10 performs deceleration fuel cutoff control so that, in a predetermined deceleration condition, that is, when the throttle valve 3 is in the fully closed position (idle switch 16 on) and also the engine speed Ne is above a predetermined cutoff starting speed, the cutoff of injection of fuel from the fuel injection valve 5 is started and, when either the throttle 3 is opened (idle switch 16 off) or the engine speed Ne falls below a predetermined recovery engine speed, the injection of fuel is resumed (deceleration fuel cutoff means). It will be understood that, in addition to the throttle opening and the engine speed Ne, it is possible to add vehicle speed as a judgment criterion, and to change the cutoff starting engine speed and recovery engine speed in accordance with factors such as whether the air conditioner is on or off, and the temperature of the cooling water.

Figure 2:
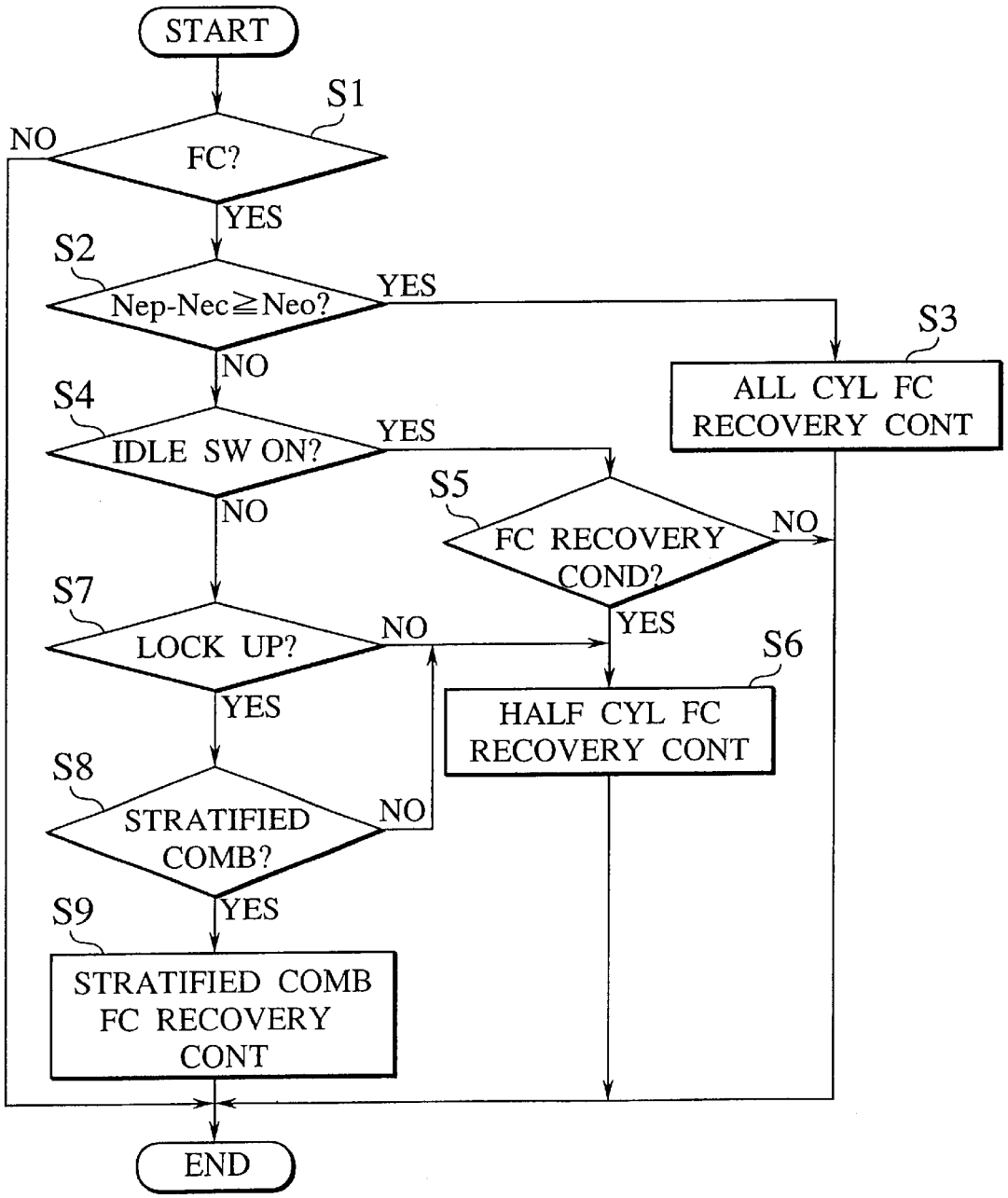
FIG. 2 is a flowchart showing the selection of control mode when fuel injection is resumed according to the embodiment.
Figure 3:
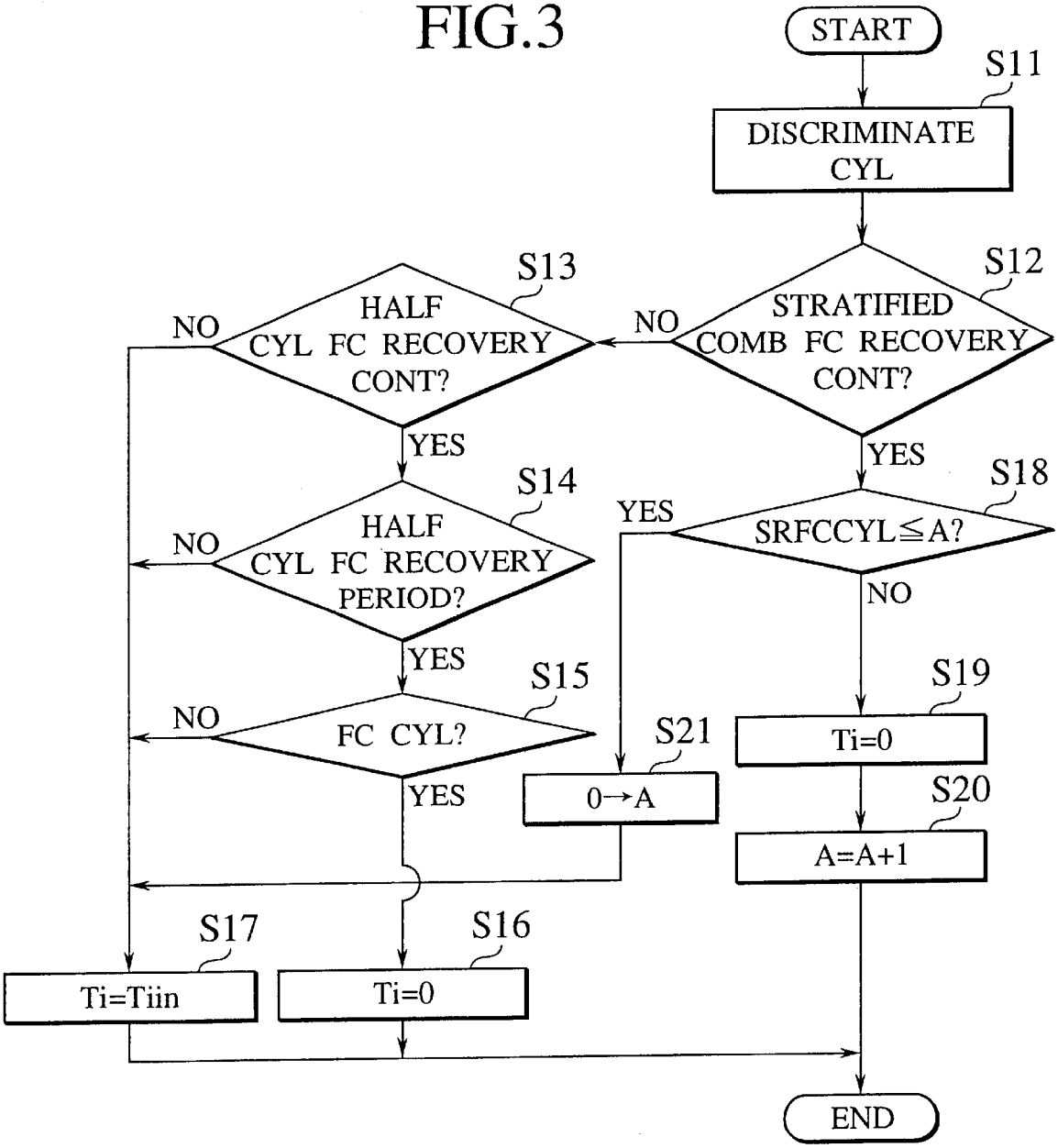
FIG. 3 is a flowchart showing the setting of the amount of the fuel injection when the fuel injection is resumed according to the embodiment.

The control unit 10, as shown in the flowcharts of FIG. 2 and FIG. 3, performs control of the resumption of fuel injection from the condition in which fuel injection is cutoff.

The flowchart of FIG. 2 shows a routine for the purpose of selecting the control mode when fuel injection is resumed, this routine being executed at a predetermined interval (for example, every 10 milliseconds) when the ignition switch is on.

First, at step S1 a judgment is made as to whether or not the engine 1 is in the deceleration fuel cutoff (FC) condition. If the judgment is made that the engine 1 is not in the deceleration fuel cutoff condition, the current processing is ended.

If, however, it is judged that the current engine condition is that of deceleration fuel cutoff (FC), the program control proceeds to step S2, at which a judgment is made as to whether or not the drop in the engine speed Ne (difference between the engine speed Nep, at a predetermined previous time, and the most recent speed Nec, i.e. Nep−Nec ) exceeds a predetermined engine speed Neo, thereby making a judgment as to whether or not sudden deceleration is being done. It will be understood that this judgment can also be made based on the actual vehicle speed.

If the judgment is made that sudden deceleration is in progress, the program control proceeds to step S3 for the purpose of resuming fuel injection to all cylinders at once. That is, In the step S3, all-cylinder FC recovery control is set as fuel-cutoff resumption control (FC recovery control). When this is done, fuel is injected during the intake stroke so as to form a homogeneous gas mixture and homogeneous combustion is performed.

If, however, the drop in the engine speed Ne is less than the predetermined drop in speed, the judgment is made that the engine 1 is not in sudden deceleration, control proceeding to step S4, at which a determination is made as to whether the idle switch 16 of on or off.

If the judgment is made that the idle switch 16 is on and that the throttle valve 3 is maintained in the fully closed condition, the program control proceeds to step S5, at which a judgment is made as to whether or not the conditions for fuel injection resumption (FC recovery conditions) other than the idle switch 16 being off are satisfied. If the judgment is made that the conditions for FC recovery are satisfied, the program control proceeds to step S6, at which half-cylinder FC recovery control is selected as the FC recovery control. This half-cylinder recovery control is performed when the vehicle speed is below a predetermined value.

The half-cylinder recovery control is control that, when the recovery condition is satisfied, first performs fuel injection in one-half of the cylinders, after which fuel injection is resumed in all of the cylinders. It is, of course, also possible to variably control the amount of time during which fuel injection is done into only one-half of the cylinders. In the case of an odd number of cylinders, the number of cylinders taken as one-half of the cylinders is one of the integer values that neighbor the integer part resulting when the number of cylinders is divided by 2. Thus, for a five-cylinder engine, this would be either two cylinders or three cylinders.

At the step S5, if the judgment is made that the FC recovery conditions have not been satisfied, this routine is terminated at this point, so that the fuel cutoff condition is continued.

If at the step S4 the judgment is made that the idle switch 16 is off (throttle valve 3 in the open condition), that is, a judgment is done that fuel injection should be resumed accompanied with acceleration, the program control proceeds to step S7, at which a judgment is made as to whether or not the torque converter TC is locked up (mechanically linked condition).

If the judgment is made that the torque converter TC is not in the locked up condition, because the shock-absorbing action of the torque converter TC will act to limit the occurrence of an acceleration shock even if resumption of fuel injection causes a sudden change in the engine torque, in order to eliminate an unnecessary delay in the fuel injection, the program control proceeds to step S6, at which the half-cylinder FC recovery control is selected. At this point, in the half-cylinder recovery control, if the torque required based on the amount of accelerator pedal depression and engine speed Ne is smaller than a predetermined amount, the fuel injection timing is set so that the fuel injection is done during the compression stroke, but if the torque is greater than the predetermined value the fuel injection timing is set so that fuel injection is done during the intake stroke.

If the judgment is made that the torque converter TC is in the locked up condition, because a sudden change in engine torque will be directly reflected in an acceleration shock, the program control proceeds to step S8, at which a judgment is made of whether or not the resumption of fuel injection is to be made using the stratified combustion.

At this point, if the judgment is made that the resumption of fuel injection is to be made by the homogeneous combustion (fuel injection during the intake stroke), because the torque up-ramping response to the resumption of fuel injection is slower than in the case of stratified combustion, the program control proceeds to the step S6, at which the normal half-cylinder recovery FC control is selected.

If, however, the judgment is made that the resumption of fuel injection is to be made by the stratified combustion (fuel injection during the compression stroke), because the torque up-ramping response is faster than the case of homogeneous combustion, leading to the possibility of the acceleration shock, the program control proceeds to step S9, at which stratified combustion FC recovery control is selected, in order to achieve a torque up-ramping response that is equivalent to that of the homogeneous combustion.

FIG. 3 is a flowchart that shows the setting of the amount of fuel injection when resuming the fuel injection, this routine being executed at each start of fuel injection.

At step S11, a determination is made as to what cylinder is to receive fuel injection.

At step S12, a judgment is made as to whether or not the stratified combustion FC recovery control is selected.

In the case in which it is judged that the stratified combustion FC recovery is not selected, the program control proceeds to step S13, at which a judgment is made as to whether or not the half-cylinder FC recovery control is selected.

In the case in which the judgment is made that the half-cylinder FC recovery control is selected, the program control proceeds to step 14, at which a judgment is made as to whether or not the half-cylinder FC recovery period has elapsed, that is, whether or not a period for injection the fuel by use of the half-cylinder has elapsed.

In the case in which the judgment is made that the half-cylinder FC recovery period has not elapsed, the program control proceeds to step S15, at which a judgment is made as to whether or not the current cylinder is a cylinder for which the fuel is to be cut off (that is, whether or not it is a cylinder other than the cylinders that receive the fuel injection). If the judgment is made that the current cylinder is one in which the fuel injection is to be cut off, the program control proceeds to step S16, at which a fuel injection amount Ti is set to 0, this being set into an output register.

However, if the judgment is made that the half-cylinder FC recovery control is not selected, that half-cylinder FC recovery control is selected but the half-cylinder FC recovery period has already lapsed, or if the current cylinder is a cylinder to be injected with fuel even if the half-cylinder FC recovery period has not elapsed, the program control proceeds to step S17, at which the fuel injection amount Ti is set to a cylinder-specific amount of fuel injection Tiin. The cylinder-specific amount of fuel injection Tiin is calculated based on such factors as the amount of air and the target equivalent ratio at that time, this being set into the output register.

At this point, an injection pulse signal, having a pulse width that is responsive to the fuel injection amount Ti that is set in the output register is output to the fuel injection valve 5. If, however, the value of Ti is 0, the fuel injection is not performed.

If at the step S12 the judgment is made that the stratified combustion FC recovery control is selected, the program control proceeds to step S18, at which a comparison is made between a preset stored value of SRFCCYL (for example, 3) and the number of times the amount of fuel injection Ti is set to 0 (number of cylinders that are continuously cutoff from fuel; the number of fuel injection timings), this being the value A of a counter (initial value of 0).

In the case in which the counter value A is less than the predetermined value of SRFCCYL, the program control proceeds to step S19, at which the amount of fuel injection Ti is set to 0, this being set into the output register. That is, even if the throttle valve 3 is open and the recovery conditions have been satisfied, when resuming the fuel injection with the stratified combustion, for the time Δt until the counter value A exceeds the predetermined SRFCCYL value, the fuel cutoff is forcibly continued, thereby achieving a precise forced delay of the resumption of fuel injection (fuel injection resumption delay means).

Figure 4B:
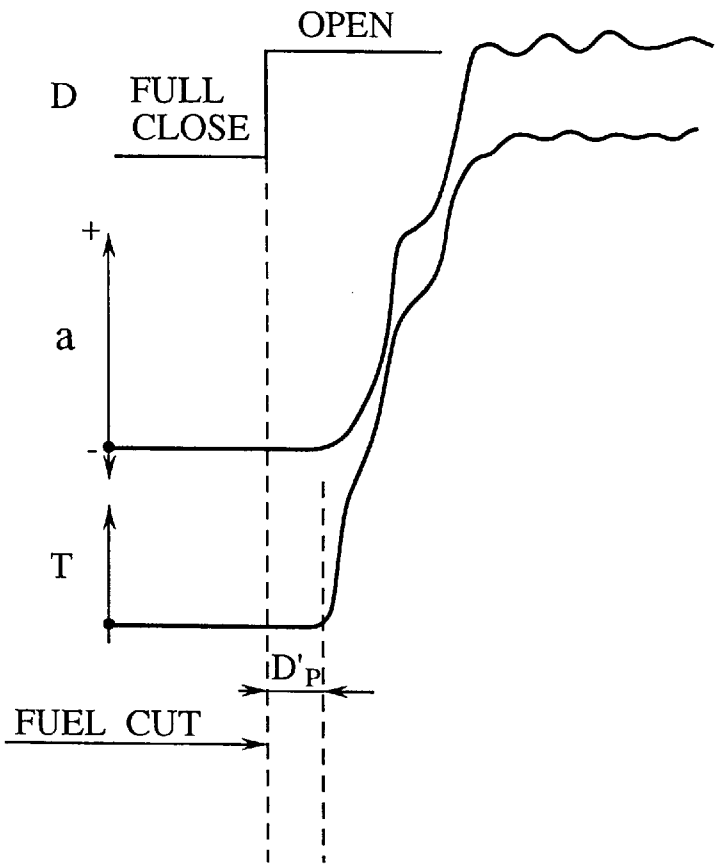
FIG. 4B is a drawing that shows the vehicle acceleration and torque characteristics when homogeneous combustion is selected for the resumption of the fuel injection.
Figure 4A:
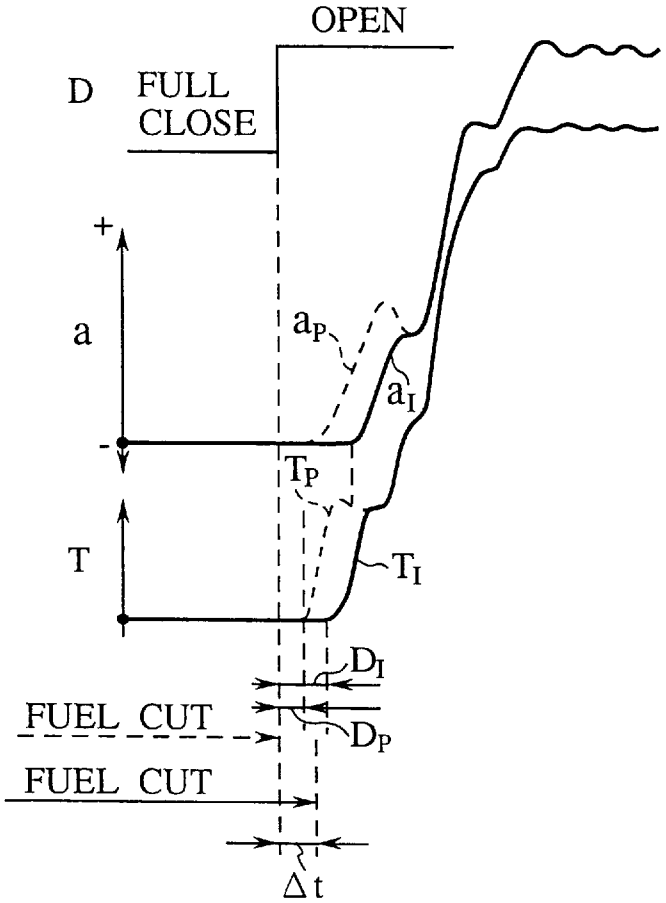
FIG. 4A is a drawing that shows the vehicle acceleration and torque characteristics when stratified combustion is selected for the resumption of the fuel injection.
Figure 5A:
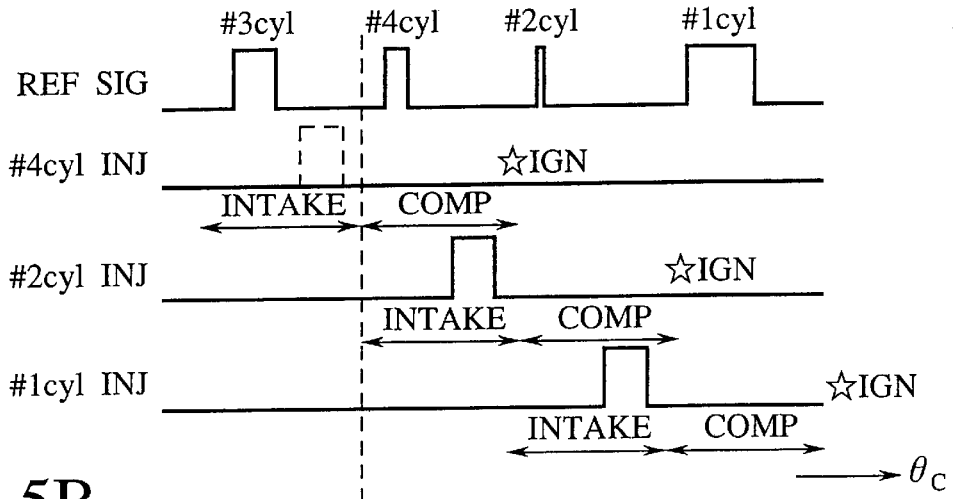
FIG. 5A is a drawing that shows the injection timing when the stratified combustion is selected for the resumption of the fuel injection.
Figure 5B:
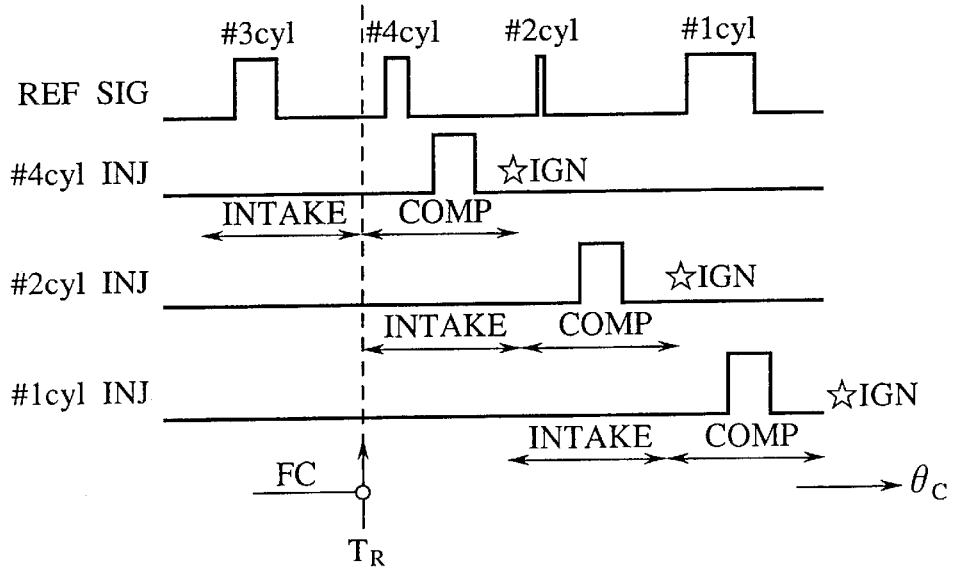
FIG. 5B is a drawing that shows the injection timing when the homogeneous combustion is selected for the resumption of the fuel injection.

By delaying the resumption of fuel injection in the above-noted manner, the torque up-ramping response and vehicle acceleration "a" during the stratified combustion indicated by the broken line in FIG. 4A changes to the solid line. That is, the delay time from the cutoff of fuel in the stratified combustion is changed from $D_P$ to $D_I$, and it can be seen that this is substantially the same as the delay time $D'_P$ from the cutoff of fuel in the homogeneous combustion in FIG. 4B.

Therefore, in the case in which the fuel injection is to be resumed from the condition in which fuel had been cutoff because of, for example, deceleration, it is possible to achieve the equivalent drivability, regardless of whether the combustion mode is the stratified combustion or homogeneous combustion, and such phenomenon as acceleration shock is avoided.

When the amount of fuel injection Ti is set to 0 at the step S19, at the next step, step S10, the counter value A is incremented by 1.

If it is judged at the step S18 that, as a result of incrementing the counter, the counter A value has reached or exceeded the predetermined value SRFCCYL, the program control proceeds to step S21, at which the counter value A is reset to 0, the stratified combustion FC recovery control is terminated, and the program control proceeds to the step S17, at which the amount of fuel injection Ti is set to the cylinder specific amount of fuel injection Tiin, this being set into the output register, thereby resuming fuel injection.

While the foregoing embodiment of the present invention was described for the case of a fixed predetermined value of SRFCCYL, it is also possible to variably set the value of SRFCCYL, for example, depending upon the correlation of the timing of the idle switch 16 turning off (the timing of judgment of acceleration) with the starting of fuel injection.

Figure 6:
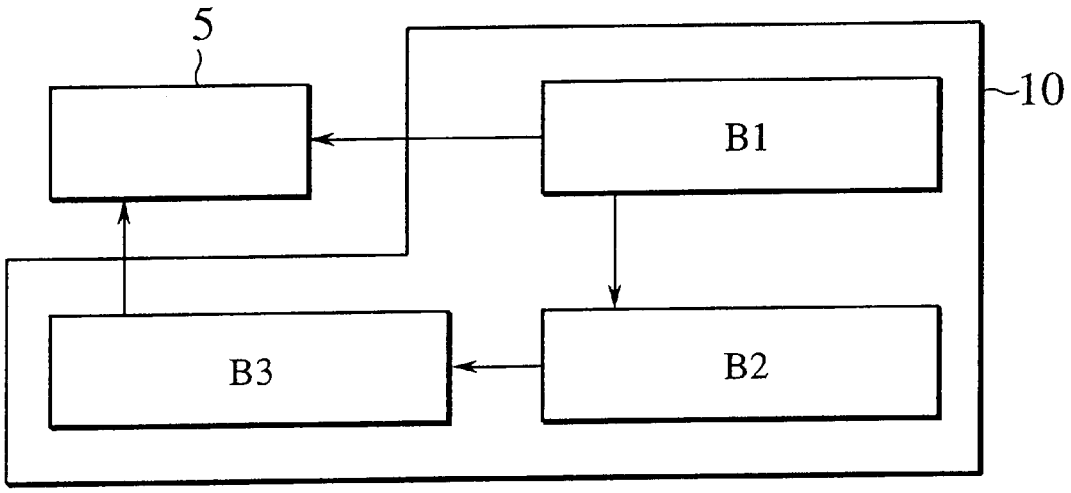
FIG. 6 is a block diagram of a direct injection engine fuel injection control apparatus according to the embodiment.

As shown in FIG. 6, the control unit 10 is structured by a fuel combustion switching section B1, a resumption delay section B2, and a fuel cutoff section B3. The fuel combustion switching section B1 switches between the homogeneous combustion, in which the fuel is injected from the fuel injection valve 5 during the intake stroke and combusted, and the stratified combustion, in which the fuel is injected from the fuel injection valve 5 during the compression stroke and combusted, depending upon driving conditions. The fuel cutoff section B3 stops the injection of fuel from the fuel injection valve 5 in a predetermined deceleration condition. When the fuel-cutoff condition, in which the fuel injection from the fuel injection valve 5 is stopped by the fuel cutoff section B3, is not satisfied because of acceleration, and in the case in which the resumption of fuel injection from the fuel injection valve is done by the stratified combustion, the resumption delay section B2 delays the resumption of fuel injection from the fuel injection valve 5 by a predetermined amount of time.

The entire contents of a Patent Application No. TOKUGANHEI 10-296878, with a filing date of Oct. 19, 1998 in Japan, are hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A direct injection engine fuel injection control apparatus comprising:

a fuel injection valve injecting fuel directly into a combustion chamber;

a combustion switching section, which, in accordance with driving conditions, switches between homogeneous combustion, in which the fuel is injected from the fuel injection valve during an intake stroke and combusted, and stratified combustion, in which the fuel is injected from the fuel injection valve during a compression stroke and combusted;

a fuel cutoff section, which, in a predetermined deceleration driving condition, stops injection of the fuel from the fuel injection valve; and a resumption delay section, which, in the case that a fuel-cutoff recovery condition in which the injection of the fuel from the fuel injection valve is resumed after a fuel cutoff is satisfied, and also that a resumption of the injection of the fuel from the fuel injection valve is to be done by the stratified combustion, delays the resumption of the injection of the fuel from the fuel injection valve by a predetermined amount of time.

2. A direct injection engine fuel injection control apparatus according to claim 1, wherein the resumption delay section delays the resumption of the injection of the fuel from the fuel injection valve until a predetermined number of injection timings of the fuel have elapsed from a point at which the fuel-cutoff recovery condition in which the fuel cutoff section stops the fuel cutoff is satisfied.

3. A direct injection engine fuel injection control apparatus according to claim 2, wherein the predetermined number of the injection timings is a fixed value.

4. A direct injection engine fuel injection control apparatus according to claim 2, wherein the predetermined number of the injection timings is a variable value.

5. A direct injection engine fuel injection control apparatus according to claim 1, wherein the resumption delay section delays the resumption of the injection of the fuel from the fuel injection valve so that fuel combustion after the resumption of the injection of the fuel exhibits engine torque response that is equivalent to that in the case of the homogeneous combustion.

6. A direct injection engine fuel injection control apparatus according to claim 1, wherein a torque converter that has a lockup mechanism is linked to the direct injection engine, and further wherein the resumption delay section only delays the resumption of the injection of the fuel from the fuel injection valve when a further judgment is made that the torque converter is locked up.

7. A direct injection engine fuel injection control apparatus according to claim 1, wherein the resumption delay section, which, in the case that the fuel-cutoff recovery condition in which the injection of the fuel from the fuel injection valve is resumed after the fuel cutoff is satisfied because of acceleration, delays the resumption of the injection of the fuel from the fuel injection valve.

8. A direct injection engine fuel injection control apparatus comprising:

fuel injection means for injecting fuel directly into a combustion chamber;

combustion switching means for switching between homogeneous combustion, in which the fuel is injected from the fuel injection means during an intake stroke and combusted, and stratified combustion, in which the fuel is injected from the fuel injection means during a compression stroke and combusted;

a fuel cutoff means for stopping injection of the fuel from the fuel injection means; and a resumption delay means, in the case that a fuel cutoff recovery condition in which the injection of the fuel from the fuel injection means is resumed after a fuel cutoff is satisfied, and also that a resumption of the injection of the fuel from the fuel injection means is to be done by the stratified combustion, for delaying the resumption of the injection of the fuel from the fuel injection means by a predetermined amount of time.

9. A method of controlling fuel injection in a direct injection engine, comprising:

switching, in accordance with driving conditions, between homogeneous combustion, in which the fuel is injected from the fuel injection valve during an intake stroke and combusted, and stratified combustion, in which the fuel is injected from the fuel injection valve during a compression stroke and combusted;

stopping injection of the fuel from the fuel injection valve at a predetermined deceleration condition;

judging whether or not condition in which the injection of the fuel from the fuel injection valve is resumed is satisfied;

judging whether or not resumption of the injection of the fuel from the fuel injection valve is to be made by stratified combustion; and delaying, in the case that judgment is made that the condition in which the injection of the fuel from the fuel injection valve is resumed is satisfied and also that the resumption of the injection of the fuel from the fuel injection valve is to be made by the stratified combustion, the resumption of the injection of the fuel from the fuel injection valve by a predetermined amount of time.

* * * * *